US007509930B2

(12) United States Patent
duPont

(10) Patent No.: US 7,509,930 B2
(45) Date of Patent: Mar. 31, 2009

(54) INTERNAL COMBUSTION BARREL ENGINE

(76) Inventor: Stephen duPont, 328 Woods Point Rd., Osprey, FL (US) 34229

( * ) Notice: Subject to any disclaimer, the term of this patent is extended or adjusted under 35 U.S.C. 154(b) by 0 days.

(21) Appl. No.: 11/797,382

(22) Filed: May 3, 2007

(65) Prior Publication Data

US 2008/0271715 A1 Nov. 6, 2008

(51) Int. Cl.
*F02B 75/18* (2006.01)
*F01M 1/02* (2006.01)

(52) U.S. Cl. ..... 123/56.6; 123/51 R; 123/65 S; 123/196 R

(58) Field of Classification Search ..... 123/56.1–56.6, 123/56.8, 56.9, 51 R–51 BD, 69 S, 71 R, 123/73 F, 73 FA, 196 R
See application file for complete search history.

(56) References Cited

U.S. PATENT DOCUMENTS

| | | | | | |
|---|---|---|---|---|---|
| 2,080,846 | A | | 5/1937 | Heraclio | |
| 2,229,246 | A | * | 1/1941 | Istad | 123/56.6 |
| 2,475,295 | A | | 7/1949 | Sherman | |
| 2,513,083 | A | * | 6/1950 | Eckert | 123/56.6 |
| 2,513,483 | A | | 7/1950 | Hempfling | |
| 2,940,323 | A | | 6/1960 | Brock et al. | |
| 2,957,462 | A | * | 10/1960 | William | 123/56.6 |
| 3,528,394 | A | * | 9/1970 | Cummins | 123/56.6 |
| 3,528,396 | A | * | 9/1970 | Cummins | 123/56.6 |
| 4,129,102 | A | * | 12/1978 | van der Lely | 123/56.6 |
| 4,209,980 | A | | 7/1980 | Pronovost et al. | |
| 4,285,303 | A | | 8/1981 | Leach | |
| 4,489,682 | A | | 12/1984 | Kenny | |
| 4,622,927 | A | | 11/1986 | Wenker | |
| 4,688,439 | A | | 8/1987 | Cureton et al. | |
| 5,027,736 | A | | 7/1991 | Drews | |
| 5,080,561 | A | | 1/1992 | Taguchi | |
| 5,094,195 | A | | 3/1992 | Gonzalez | |
| 5,113,809 | A | | 5/1992 | Ellenburg | |
| 5,564,372 | A | | 10/1996 | Llewellyn | |
| 5,709,176 | A | | 1/1998 | Llewellyn | |
| 5,782,219 | A | | 7/1998 | Frey et al. | |
| 6,279,520 | B1 | | 8/2001 | Lowi, Jr. | |
| 6,942,742 | B2 | | 9/2005 | Yamagishi | |
| 6,968,751 | B2 | | 11/2005 | Shulenberger et al. | |
| 7,156,056 | B2 | | 1/2007 | Lemke et al. | |

* cited by examiner

*Primary Examiner*—Noah Kamen
(74) *Attorney, Agent, or Firm*—Lowe, Hauptman, Ham & Berner, LLP

(57) ABSTRACT

A two-stroke barrel engine includes a power output shaft configured to rotate, an even number of cylinders encircling the power output shaft, wherein each cylinder includes opposing first and second power pistons configured to reciprocate within their respective power cylinder, and a pair of non-rotating wobbleplates opposed and hingedly connected to the power pistons. The wobbleplates are configured to transfer the reciprocating motion of the power pistons to rotary motion of the power output shaft via a nutating motion of the non-rotating wobbleplate.

7 Claims, 3 Drawing Sheets

INTERNAL COMBUSTION BARREL ENGINE

FIELD OF THE INVENTION

The present invention relates generally to internal combustion engines, and more specifically to a two stroke barrel engine.

BACKGROUND

A barrel engine is a type of reciprocating engine that replaces the common crankshaft with a circular plate (the swashplate). Pistons press down on a circular plate in a circular sequence, forcing it to nutate around its center. The plate, also known as a wobble plate, is typically geared to produce rotary motion.

Barrel engines are differentiated from other engines in that the cylinders are arranged in parallel around the edge of the plate, and possibly on either side of it as well, and are aligned with the output shaft rather than at 90 degrees as in crankshaft engines. This design results in a very compact, cylindrical engine, ideally suited for use in aircraft engines.

DESCRIPTION OF THE DRAWINGS

One or more embodiments are illustrated by way of example, and not by limitation, in the figures of the accompanying drawings, and wherein.

DETAILED DESCRIPTION

Figure 1:
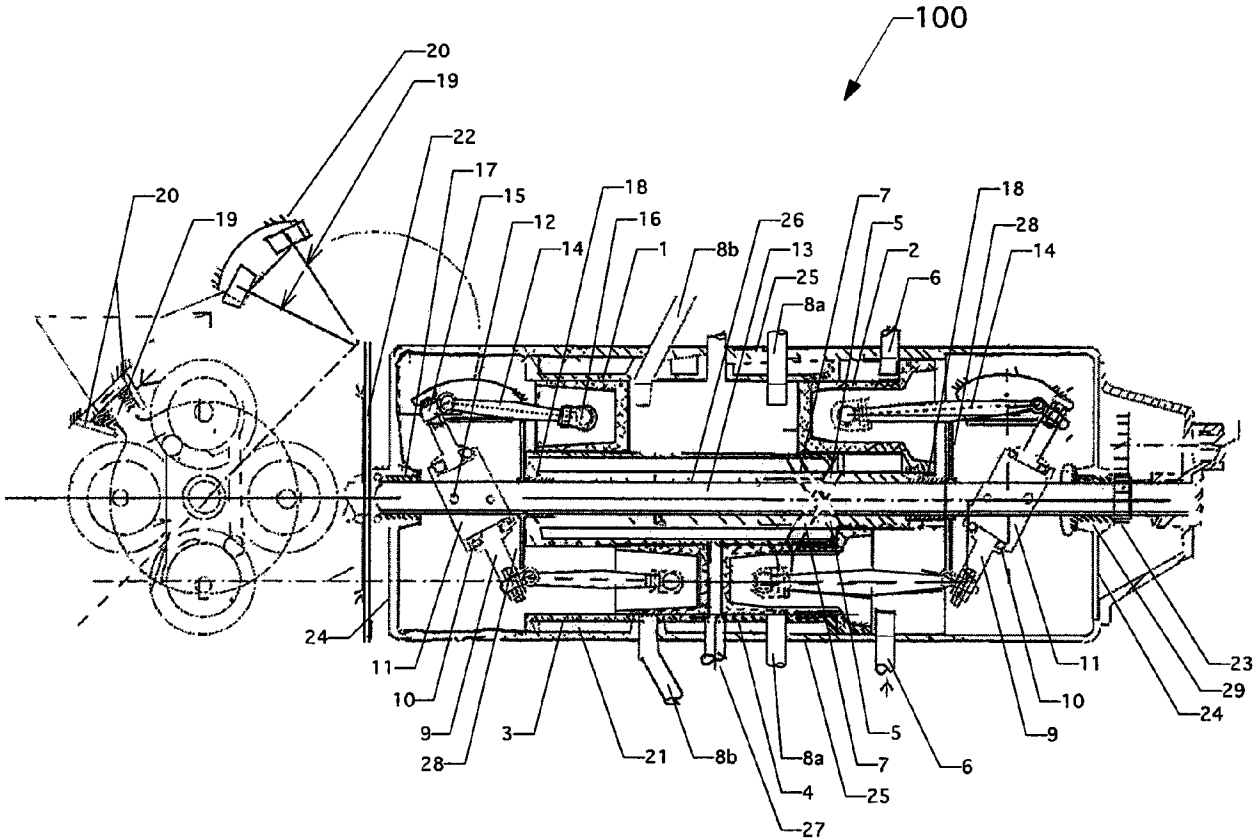
FIG. 1 illustrates a barrel engine according to an embodiment.

FIG. 1 illustrates a longitudinal view and an end view of a barrel engine 100 according to one embodiment. The engine 100 features a two stroke barrel arrangement that includes a frame, i.e., cylinder block 25, that houses an even number of cylinders encircling a power shaft 13, wherein the centerlines of all the cylinders are parallel to each other. The cylinders operate in pairs, wherein each pair of cylinders comprises the two cylinders on opposite sides of power shaft 13. Engine 100 further includes a wobbleplate drive system that includes two non-rotating wobbleplates 9, each mounted on opposite ends of cylinder block 25.

Each cylinder comprises a power cylinder comprising power sleeve 3 and a stepped charging cylinder comprising stepped sleeve 4. Disposed within each power cylinder are opposing piston 1 and 2. At a top stroke, a piston position encloses minimum cylinder volume; at a bottom stroke a piston position encloses maximum cylinder volume. Piston 1 is a power piston whose reciprocating motion drives power shaft 13. Piston 2, however, includes both a power piston and a stepped charging piston portion.

The cylinders operate in pairs opposite each other, wherein the stepped charging piston portion of piston 2 compresses inlet air to charge the two stroke power cylinder of the opposing paired cylinder.

At opposite ends of the power cylinder and at the bottom of the stroke, one of the power pistons 1 actuates an inlet port 8*b* and the stepped power piston 2 actuates an exhaust port. The ports are configured such that exhaust port 8*a* opens slightly before inlet port 8*b*. On the opposite side of wobbleplate 9, stepped piston 2 opens an inlet port 6 from the carburetor at the bottom of it's stroke. At the top of it's stroke there is an always open outlet port 5 leading into a transfer passage 7 that connects with inlet port 8*b* of the power piston it pressurizes.

The stepped piston 2 pressurizes the inlet air to charge the power cylinder of its paired cylinder. When the power piston's inlet port 8*b* has opened for inlet, at the bottom of the stroke, the stepped piston 2 opposite is at the top of it's stroke, having compressed the fuel/air mixture.

The stepped charging piston 2 of one cylinder pressurizes the power cylinder of its paired cylinder. Accordingly, each stepped piston 2 moves in the opposite direction from its paired power piston 1. The stepped piston can be large enough to produce more piston displacement than the power piston's displacement producing excess air for supercharging.

Intake port 5 is an input to the power cylinder by transfer passage 7, and the stepped charging cylinder comprises intake port 6 from a carburetor. Transfer passage 7 connects the charging cylinder to a port 8*b* of the power cylinder. The cylinder block further includes two split radial shaft main bearings 18, a cooling water jacket 21, a starter ring gear 22, an accessory drive gear 23, end housings 24, a split bore 26 in cylinder block 25 to assemble power shaft 13 into it's main bearings, spark plug bore 27, a shaft thrust bearing 17, and an oil feed bearing 29.

The pistons disposed within each power cylinder include a power piston 1 and a combination power piston and stepped charging piston 2. Connecting rods 14 connect each piston 1, 2 to wobbleplates 9 via carden type two-pin universal joints at both ends of the connecting rod 14. Because all of the pins handle the same load, the diameter of the pins is determined by the diameter of the piston wrist pins. Unlike a crankshaft connecting rod that experiences a violent lateral oscillation due to rotation of the crank, the connecting rods 14 do not need to be of the strong I-beam shape of crankshaft connecting rods. Accordingly, in one embodiment, connecting rods 14 are comprised of lightweight tubes having thick ends, the ends flattened and bored, wherein the hole for the pin goes through the thicker part of the flattened rod end. No welding or riveting is required.

As disclosed herein, wobbleplate 9 eliminates the need of piston rollers of previous wobbleplate designs and is designed according to a fatigue life determined by factors including the material used, stress in the shaft, and the number of its cycles experienced in its lifetime. Stress is based upon the value of the bending moment, caused by the spread of main bearings 18 between wobbleplates 9 and the offset of the connecting rods 14 from the shaft center and the number of cycles experienced. The greater the bearing spread, the higher the bending moment value.

Wobbleplates 9 are restricted from rotating and receive force from each piston 1, 2 equally spaced around the periphery of wobbleplate 9 by a connecting rod 14 having swiveled ends that cause wobbleplate 9 to wobble, thereby transferring the piston's reciprocating motion into rotary motion of power shaft 13.

Each wobbleplate 9 is mounted via wobbleplate mounting bearing 10 to a slug 11 with a skewed bore, and is configured to transfer reciprocating motion from pistons 1, 2 into rotary motion of power shaft 13 passing through slug 11. Pin 12 secures slug 11 to power shaft 13. Connecting rod 14 includes hinged ends mounted to hinged double pin carden joints. The hinged connection 15 of wobbleplate 9 to the connecting rod 14 allows angular motion of connecting rod 14 at the wobbleplate 9. Hinged carden joint 16 includes a piston wrist pin.

Wobbleplates 9 are non-rotating. In the embodiment illustrated in FIG. 1, anti-rotator rod 19 is fixed to, and extends radially from, the periphery of each wobbleplate 9. Non-limiting, wobbleplate 9 is prevented from rotating by a pair of fixed planar members 20 straddling the anti-rotator rod 19, the straddling members lying in planes parallel to the centerline of power shaft 13 and anchored to frame 25 of engine 100. As wobbleplate 9 rocks, anti-rotator rod 19 slides always parallel to the centerline of power shaft 13 preventing wobbleplate 9 from rotating.

Figure 2:
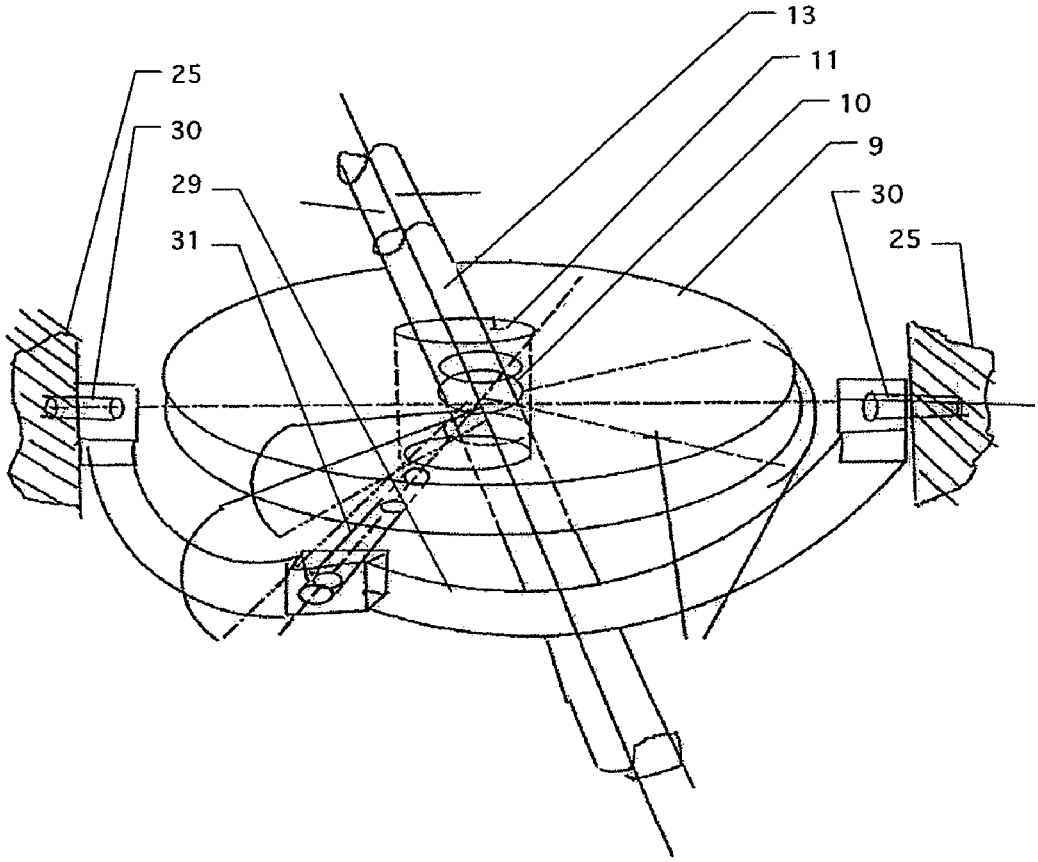
FIG. 2 is a diagram of a wobbleplate bearing illustrating an alternative anti-rotating arrangement.
Figure 3:
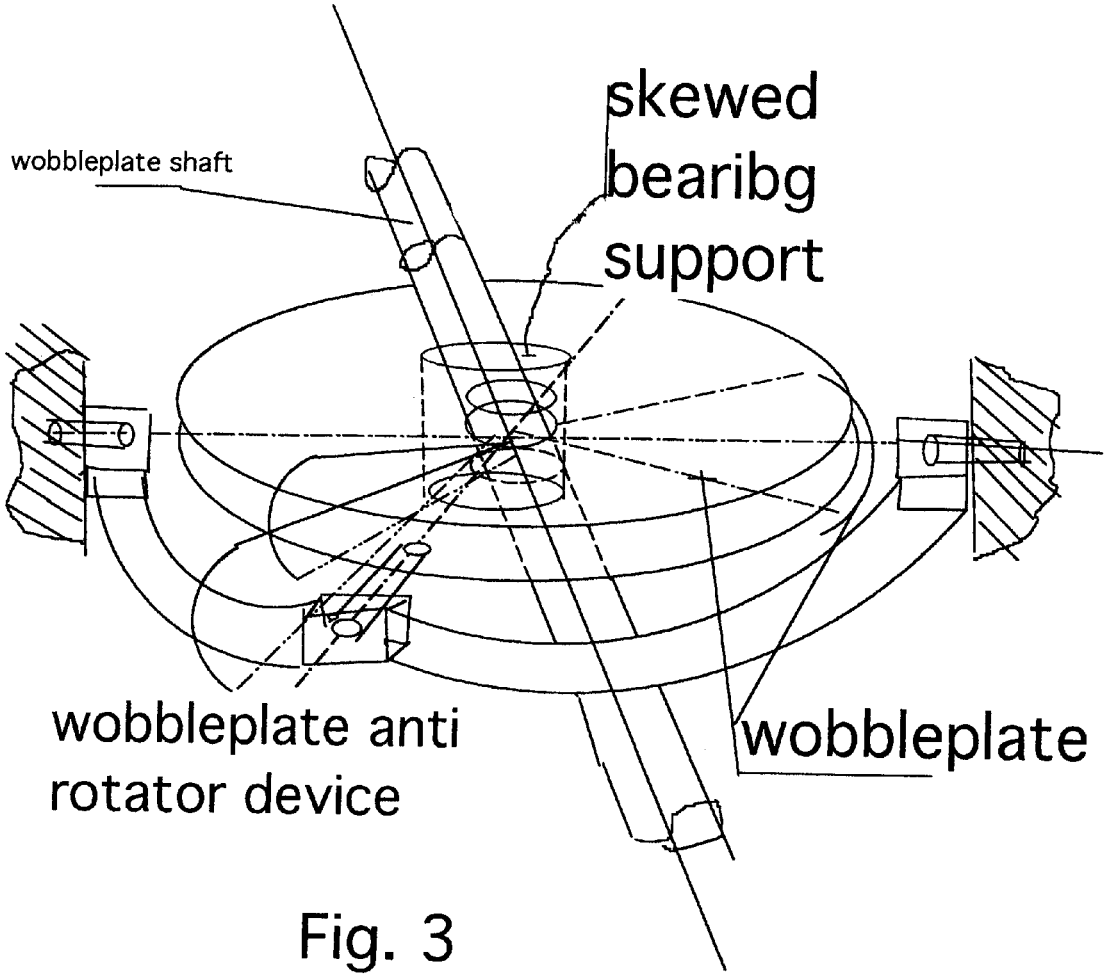

FIG. 2 illustrates another embodiment of an anti-rotator device wherein rotation of each wobbleplate 9 is prevented by a rotatable yoke 29 having at least one of its ends pivoted 90 degrees around a rotation restraint pin 31 mounted to the outside of wobbleplate 9, and at least one other end of yoke 29 connected to frame 25 via attachment pin 30. Rotation restraint pin 31 is configured to swivel into yoke 29, allowing yoke 29 to rotate, while preventing the rotation of wobbleplate 9.

Rotation restraint pin 31, mounted to the periphery of wobbleplate 9, oscillates, following the angle of wobbleplate 9 twice every revolution of shaft 13 as pin 31 slides back and then forth with the wobble. Furthermore, rotation restraint pin 31 carries the load of wobbleplate 9 from connecting rods 14. Accordingly rotation restraint pin 31 is preferably lubricated by the surrounding load-carrying bushings.

In one embodiment, shaft 13 is hollow and contains oil under pressure. A groove disposed all the way around the inside of bearing 29 allows oil to flow from skewed slug 11 through wobbleplate 9 to rotation restraint pin 31 or anti-rotator rod 19.

In an alternate embodiment, a non-wobbling oil disc 28 is mounted on power shaft 13 between the wobbleplate 9 and the cylinder block. Unlike oil being dispersed from wobbleplate 9, non-wobbling oil-disk 28 has an advantage of directing oil into the cylinders with greater accuracy without squirting oil in a trajectory determined by the wobble.

What I claim is:

1. A two-stroke internal combustion engine, comprising:

a cylinder block that includes an even number of parallel cylinders encircling a power shaft, each cylinder comprising an inlet port, an exhaust port, and a set of opposing pistons configured to reciprocally traverse the cylinder;

two non rotating wobbleplates on opposite sides of the cylinder block, each wobbleplate tilt and bearing mounted to the power shaft and configured to transfer the reciprocal motion of the pistons to a rotary motion of the power shaft; and a disc member securely mounted around the power shaft between each wobbleplate and the cylinder block, the disc member configured to distribute oil to the cylinders;

wherein each piston is hinged to a periphery of a wobbleplate via a connecting rod.

2. An engine according to claim 1, wherein the power shaft is hollow and is configured to feed oil through the wobbleplates to each of the cylinders.

3. A two-stroke barrel engine comprising:

a power shaft configured to rotate;

an even number of cylinders encircling the power shaft, each cylinder comprising opposing first and second power pistons configured to reciprocally traverse their associated cylinder;

a pair of non-rotating wobbleplates opposed, and hingedly connected to the power pistons, the wobbleplates configured to transfer the reciprocating motion of the power pistons to rotary motion of the power output shaft via a nutating motion of the wobbleplates; and a disc member securely mounted around the power shaft between each wobbleplate and the cylinder block, the disc member configured to distribute oil to the cylinders.

4. A two-stroke barrel engine according to claim 3, wherein each wobbleplate comprises means for preventing rotation thereof.

5. A two-stroke barrel engine according to claim 3, wherein a plurality of connecting rods having a circular cross section are hingedly connected to a periphery of the wobbleplate, wherein the wobbleplate is configured to exhibit motion only in a plane parallel to the power shaft.

6. A two-stroke barrel engine according to claim 5, further comprising:

an anti-rotator rod fixed to, and extending radially from, a periphery of each wobbleplate; and a pair of fixed planar members straddling the anti-rotator rod, the straddling members lying in planes parallel to a centerline of the power shaft and anchored to a frame of the engine;

wherein the anti-rotator rod and fixed planar members are configured to prevent the wobbleplate from rotating.

7. A two-stroke barrel engine according to claim 3, wherein the cylinders operate in pairs 180 degrees apart from each other and wherein the second power piston of a first cylinder of a pair of cylinders includes a stepped piston portion configured to compress inlet air to a second cylinder of the pair of cylinders

* * * * *